United States Patent [19]

Wilson et al.

[11] Patent Number: 4,867,237

[45] Date of Patent: Sep. 19, 1989

[54] PRESSURE MONITORING APPARATUS

[75] Inventors: Dennis R. Wilson, Ponca City; Robert L. Coffee, Newkirk, both of Okla.

[73] Assignee: Conoco Inc., Ponca City, Okla.

[21] Appl. No.: 267,213

[22] Filed: Nov. 3, 1988

[51] Int. Cl.[4] ..... E21B 47/06

[52] U.S. Cl. ..... 166/250; 166/113

[58] Field of Search ..... 166/113, 114, 115, 116, 166/133, 135, 185, 188, 192, 195, 250

[56] References Cited

U.S. PATENT DOCUMENTS

| | | | |
|---|---|---|---|
| 3,198,257 | 8/1965 | Myers | 166/136 |
| 3,204,697 | 9/1965 | Gaut | 166/133 |
| 3,812,911 | 5/1974 | Vann | 166/135 |
| 4,044,827 | 8/1977 | Kerzee et al. | 166/133 |
| 4,051,897 | 10/1977 | Kingelin | 166/115 |
| 4,134,452 | 1/1979 | Kingelin | 166/133 |
| 4,159,643 | 7/1979 | Watkins | 166/250 X |
| 4,252,195 | 2/1981 | Fredd | 166/314 |
| 4,669,537 | 6/1987 | Rumbaugh | 166/113 |

OTHER PUBLICATIONS

Baker Packers Model FWG Bypass Blanking Plug, p. 893, vol. 1, 1982–1983, Composite Catalog of Oilfield Equipment and Services.

Baker Packers Model F Seating Nipple, p. 888, vol. 1, 1982–1983, Composite Catalog of Oilfield Equipment and Services.

*Primary Examiner*—William P. Neuder

*Attorney, Agent, or Firm*—Richard K. Thomson

[57] ABSTRACT

A pressure monitoring apparatus for use in a tubing string having a landing nipple located therein above a well zone which is to be monitored includes a plug body, a mandrel sleeve, a pressure communication mandrel and a pressure sensor. The plug body is landed in the landing nipple, and has an axial body bore therethrough. The mandrel sleeve has a lower portion constructed to be sealingly received within the body bore, and has an axial sleeve bore disposed therethrough. The pressure communication mandrel has a lower portion constructed to be sealingly received within the sleeve bore, and has a pressure communication passage disposed therethrough for communicating the pressure sensor with the well zone. The pressure monitoring apparatus can be adapted for use in methods of monitoring pressure fall-off in a subsurface formation after injection of fluid into the formation, and also can be adapted for use in methods of monitoring a bottom hole shut-in pressure buildup in a production well.

25 Claims, 3 Drawing Sheets

PRESSURE MONITORING APPARATUS

BACKGROUND OF THE INVENTION

1. Field Of The Invention

This invention relates generally to apparatus for making bottom hole shut-in pressure measurements in a well.

2. Description Of The Prior Art

The prior art includes a number of apparatus which provide means for shutting in a well at a desired downhole elevation, and then providing pressure communication across the shut-in point so that the measurement of pressure within the well below the shut-in point can be performed.

One example of such a tool is that shown in U.S. Pat. No. 4,134,452 to Kingelin. The Kingelin '452 tool includes a locking mandrel which is landed in a landing nipple located in the tubing string. A tool stem is run into the well on a wireline and is sealingly received within the bore of the locking mandrel. The tool stem includes a central opening which provides for pressure communication with a pressure indicating device.

Other somewhat similar devices are shown in U.S. Pat. No. 4,051,897, also to Kingelin and in U.S. Pat. No. 4,252,195 to Fredd.

The prior art also includes a prior commercial use by the assignee of the present invention of apparatus somewhat like that described above, for the purpose of shutting in an injection well and then measuring pressure fall-off data in the formation into which fluids have been injected. This prior use involved apparatus illustrated in FIGS. 2–5 of the present application.

FIG. 2 depicts a Model "FWG" bypass blanking plug with removable mandrel manufactured by Baker Packers, a division of Baker International Corporation of Houston, Tex. This Model "FWG" bypass blanking plug is disclosed at page 893 of Volume 1 of the 1982–1983 *Composite Catalog of Oilfield Equipment and Services.* The bypass blanking plug illustrated in FIG. 2 is constructed for use with a Model "F" seating nipple also manufactured by Baker Packers, as illustrated at page 888 of Volume 1 of the 1982–1983 *Composite Catalog of Oilfield Equipment and Services.*

The aforementioned prior use by the assignee of the present invention utilized a Baker Packers Model "FWG" bypass blanking plug which had been modified as shown in FIG. 3, and which was used in connection with a pressure communication mandrel illustrated in FIG. 4.

In FIG. 3, the Baker Packers Model "FWG" bypass blanking plug has had its sliding central mandrel and other related components removed, and has had an annular insert A inserted therein. The insert A has defined in the upper end thereof a conically tapered guide means B. The bottom clean-out plug C seen in FIG. 2 has been removed as part of the modifications illustrated in FIG. 3.

In this prior commercial use, the modified Baker Packers Model FWG bypass blanking plug of FIG. 3 was landed in a Baker Packers Model "F" seating nipple located above a subsurface formation into which fluid was being injected. Then, the pressure communication mandrel of FIG. 4 was assembled with a pressure measuring apparatus and lowered into engagement with the modified Baker Packers Model "FWG" bypass mandrel as illustrated in FIG. 5, so that further downward flow of fluid was stopped. The pressure measuring apparatus connected to the upper end of the pressure communication mandrel communicated through the pressure communication mandrel with the subsurface formation so as to measure pressure fall-off in the formation while isolating the formation from hydrostatic pressure within the well tubing.

The prior use described above involved small diameter 1.900-inch OD tubing. The Baker Packers Model "F" nipple had a 1.50-inch inner bore in which the Model FWG bypass blanking plug was landed.

The bypass blanking plug had a bore D of about 0.375 inches inside diameter in which the lower end of the pressure communication mandrel of FIG. 4 was received.

With this relatively small diameter equipment, it was possible to pull the pressure communication mandrel out of engagement with the Model "FWG" bypass blanking plug by pulling upwards on the pressure communication mandrel with a standard wireline. A pull of only approximately 400 to 500 pounds was required to disengage the pressure communication mandrel of FIG. 4 from the combined apparatus illustrated in FIG. 5. This necessary upward pressure is dependent upon the difference between the hydrostatic head trapped above the pressure communication mandrel and the lower pressure found in the well below the pressure communication mandrel, and is also dependent upon the cross-sectional area of the lower portion of the pressure communication mandrel.

While the approach taken in the prior art apparatus illustrated in FIGS. 2–5 wherein the Baker Packers Model "FWG" bypass blanking plug is modified by removing its mandrel and replacing it with a pressure communication mandrel like that of FIG. 4 is satisfactory for small diameter tubing like that described, such an approach is less satisfactory for larger sizes of equipment. In larger tubing the necessary diameter of the lower portion of the pressure communication mandrel in order to fill the plug body opening is so large that a very large upward force would be necessary to overcome the hydrostatic head trapped above the pressure communication mandrel. When the upward force necessary to disengage the pressure communication mandrel is greater than that which can be provided by a standard wireline apparatus, the use of this procedure becomes much less desirable.

Also the apparatus of FIGS. 2–5 is suitable only for use in an injection well. It is not suited to use in a producing well.

SUMMARY OF THE INVENTION

The present invention improves upon the apparatus illustrated in FIGS. 2–5 by providing a means for reducing the necessary diameter of the lower end of the pressure communication mandrel. Even in equipment used with large sizes of tubing, the present invention allows a relatively small diameter lower end to be utilized on the pressure communication mandrel so that the pressure communication mandrel can be retrieved with the use of a standard wireline.

This is accomplished by the use of a mandrel sleeve which has a lower cylindrical sleeve portion sealingly received within the lower bore of the plug body. The sleeve is provided with an axial sleeve bore of relatively small diameter within which a pressure communication mandrel can be received.

When used in an injection well, this mandrel sleeve is assembled with the modified blanking plug which is then landed in the nipple which is located in the tubing string.

Then, a pressure measuring apparatus can be assembled with a pressure communication mandrel and lowered into engagement with the mandrel sleeve in order to shut in the well and provide pressure communication to the pressure measuring apparatus.

Upon completion of the pressure measurements, the pressure measuring apparatus and pressure communication mandrel can be retrieved with a standard wireline, and the mandrel sleeve is held in place within the plug body by means of the downward pressure exerted thereon by the hydrostatic pressure in the tubing string above the plug body.

After the pressure communication mandrel has been retrieved, pressure will equalize across the plug body since there will then be an opening through the plug body, and then the entire assembly of the plug body and the mandrel sleeve can be retrieved from the well.

Another embodiment of the present invention provides a bottom hole shut-in apparatus which is suitable for use in a production well for the measurement of bottom hole shut-in pressure buildup.

In this embodiment, the mandrel sleeve preferably has a smaller sleeve bore therethrough on the order of one-eighth inch diameter, and a latch means is provided for latching the mandrel sleeve in place.

The pressure communication mandrel and mandrel sleeve are made up together and run down into the well and stung into place within the plug body which has previously been seated in the well.

This arrangement provides a bottom hole shut-in apparatus, which prior to shut in provides a relatively unrestricted flow passage. After the bottom hole shut-in pressure buildup measurements have been taken, the pressure communication mandrel can be pulled out of engagement with the mandrel sleeve thus allowing pressure to balance across the plug body before the plug body and other apparatus are removed from the well.

Numerous objects, features and advantages of the present invention will be readily apparent to those skilled in the art upon a reading of the following disclosure when taken in conjunction with the accompanying drawings.

DESCRIPTION OF THE PREFERRED EMBODIMENTS

Figure 1:
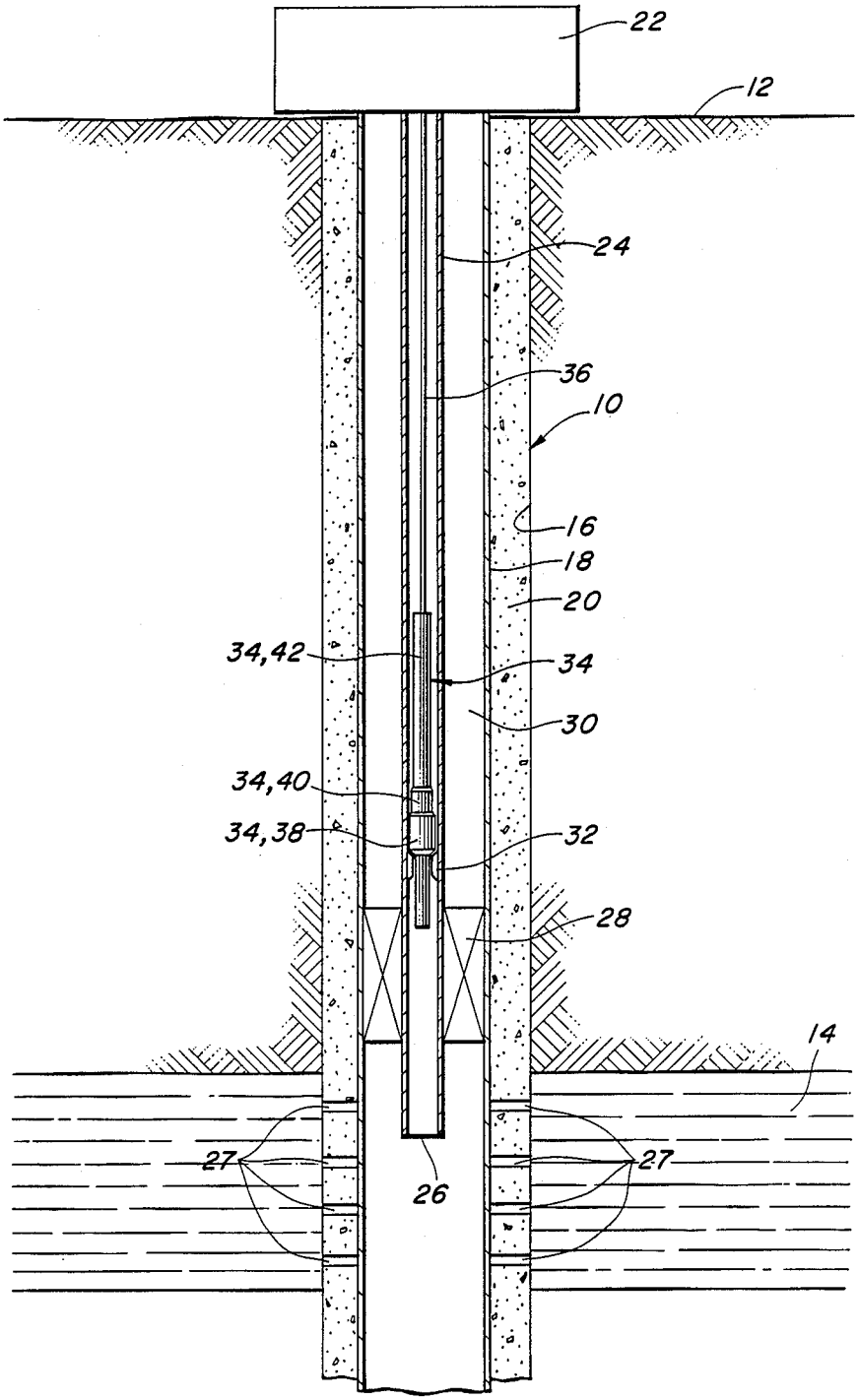
FIG. 1 is a schematic elevation view illustrating the apparatus the present invention in place within a well.
Figure 5:
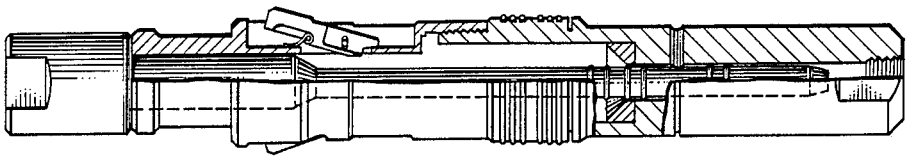
FIG. 5 (PRIOR ART)
FIG. 5 is an assembled view of the modified blanking plug of FIG. 3 and the pressure communication mandrel of FIG. 4, which combination is itself also a part of the prior art.
Figure 4:
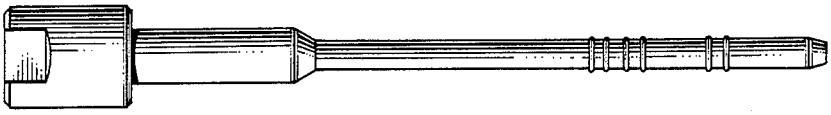
FIG. 4 (PRIOR ART)
FIG. 4 is an elevation view of a pressure communication mandrel previously used by the assignee of the present invention, is a part of the prior art.
Figure 3:
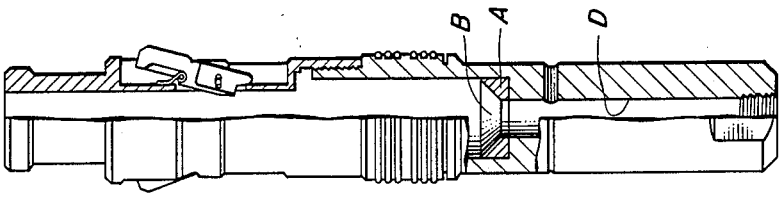
FIG. 3 (PRIOR ART)
FIG. 3 is an elevation partly sectioned view of a modified version of the blanking plug of FIG. 2, which is also a part of the prior art.
Figure 2:
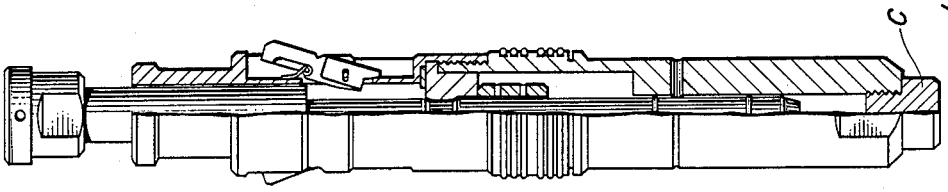
FIG. 2 (PRIOR ART)
FIG. 2 is an elevation partly sectioned view of a prior art Baker Packers Model "FWG" bypass blanking plug.

Referring now to FIG. 1, an elevation cross section generally schematic view is there shown of a well 10 extending downward from the earth's surface 12 to intersect a subsurface formation or well zone 14.

The well 10 is constructed by drilling a bore hole 16 into the earth. A cylindrical steel casing 18 is then placed within the bore hole 16 and cemented in place with cement 20.

A conventional wellhead assembly 22 closes in the upper end of the well 10.

A tubing string 24 extends down into the well and communicates with the subsurface formation 14 through its lower end 26 and through perforations 27.

A packer 28 seals an annular space 30 defined between the tubing string 24 and the casing 18.

The tubing string 24 has a tubing nipple 32 assembled therein. The tubing nipple 32 may, for example, be a Baker Packers Model "F" seating nipple, as manufactured by the Baker Packers division of Baker Packers International Corporation of Houston, Texas. The tubing nipple 32 may also be referred to as a landing nipple or a seating nipple.

In FIG. 1, a portion of pressure monitoring apparatus generally designated by the numeral 34 has been lowered into place on a wireline 36 and landed in the landing nipple 32.

The pressure monitoring apparatus 34 generally includes a plug assembly 38 which is landed in the landing nipple 32, a pressure communication mandrel 40 which is received in the upper end of the plug assembly 38, and a pressure sensing means 42 which is connected to the upper end of the pressure communication mandrel 40 and which is suspended from the wireline 36.

Figure 6:
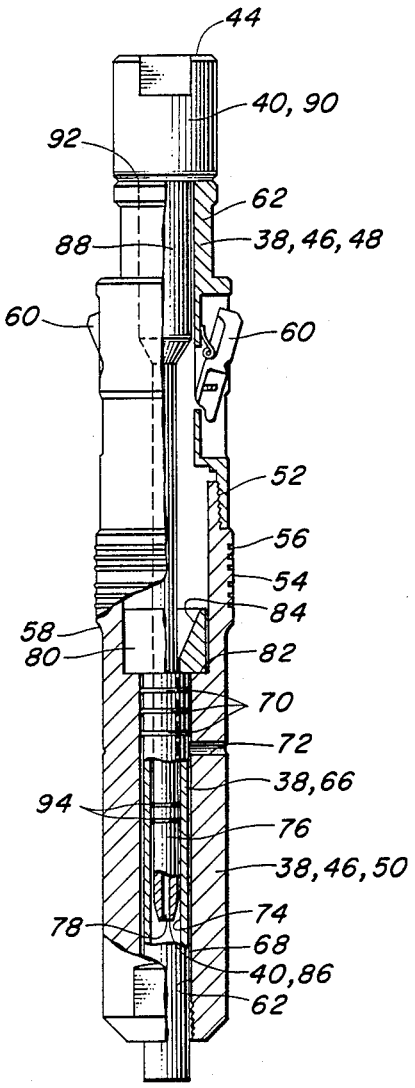
FIG. 6 is an elevation partly sectioned view of the pressure monitoring apparatus of the present invention including a mandrel sleeve received in a plug body, which mandrel sleeve has an axial sleeve bore within which a pressure communication mandrel is received. This embodiment is particularly for use in an injection well.
Figure 7:
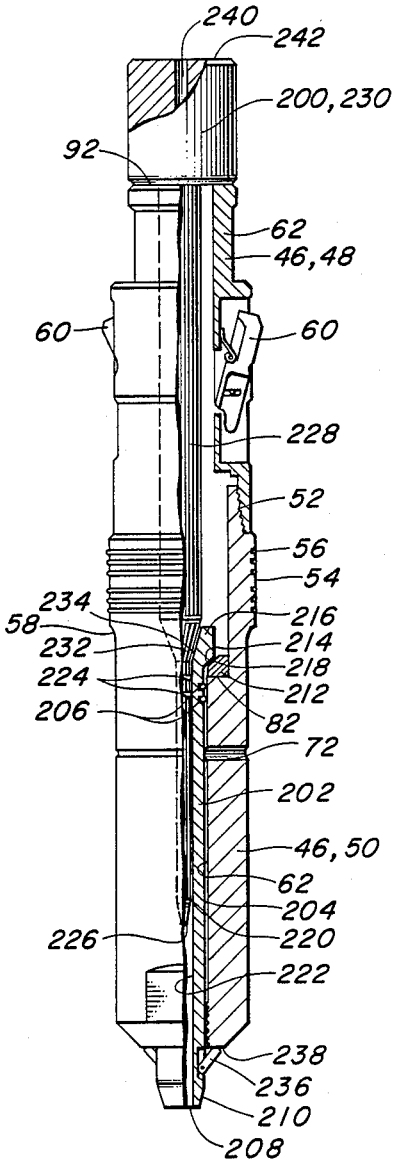
FIG. 7 is a view similar to FIG. 6 showing an alternative embodiment of the present invention having a latch means for latching the pressure communication mandrel in place, and having a relatively small diameter sleeve bore. This embodiment is particularly adapted for use in a production well.

There are two embodiments of the present invention, one of which is particularly adapted for use for bottom hole shut-in an injection well, and the other of which is particularly adapted for use for bottom hole shut-in in a production well. In FIG. 6, a detailed drawing is shown of the apparatus as adapted for use in an injection well. In FIG. 7, a detailed view is shown of the apparatus as adapted for use in a production well.

BOTTOM HOLE SHUT-IN OF AN INJECTION WELL

FIG. 6 is an elevation partly sectioned view of the plug assembly 38, and pressure communication mandrel 40 of the pressure monitoring apparatus 34. Although not shown in FIG. 6, the pressure sensing means 42 is generally connected to an upper end 44 of pressure communication mandrel 40.

The plug assembly 38 includes a plug body 46 which is constructed to be sealingly landed in the tubing nipple or landing nipple 32.

For example, if a Baker Packers Model "F" landing nipple is used for the landing nipple 32, the plug body 46 may be constructed by modification of a Baker Packers Model "FWG" bypass blanking plug.

The plug body 46 has an upper portion 48, and a lower portion 50 threaded connected together at 52.

Lower body portion 50 has an enlarged outside diameter area 54 which is constructed to be closely received in a seal bore of landing nipple 32. A plurality of sealing rings such as 56 seal between the plug body 46 and the seal bore of landing nipple 32. A downward facing annular shoulder 58 of lower body portion 50 lands against a complementary shoulder of the landing nipple 32.

The upper body portion 48 carries a plurality of locking dogs 60 which latch in an internal groove (not shown) of the landing nipple 32.

Upper body portion 48 has a fishing neck 62 defined thereon for use in retrieval of plug body 46.

The lower body portion 50 has an axial body bore 62 disposed therethrough.

The plug assembly 38 also includes a mandrel sleeve 66 which has a lower cylindrical sleeve portion 68 constructed to be sealingly received within the body bore 62. A plurality of O-ring seals 70 disposed in annular outer grooves of mandrel sleeve 66 seal between the sleeve 66 and body bore 62 above an elevation of a port 72. It is noted that the port 72 shown in FIG. 6 is a port which is an integral part of a Baker Packers Model "FWG" bypass blanking plug, and it is necessary to seal above that port 72 when modifying the Model "FWG" plug for use with the present invention. The port 72, itself, actually serves no function in the present invention.

The mandrel sleeve 66 has an axial sleeve bore 74 disposed therethrough.

The pressure communication mandrel 40 has a lower cylindrical mandrel portion 76, which may also generally be referred to as a stinger portion 76, which is constructed to be sealingly received within the sleeve bore 74.

The pressure communication mandrel 40 has a pressure communication passage means 78 disposed therethrough for communicating the pressure sensing means 42 with the well zone 14.

The mandrel sleeve 66 has an enlarged head 80 located above lower cylindrical sleeve portion 68 and abutting an upward facing annular shoulder 82 defined within the lower plug body portion 50.

An inner conically downward tapered guide surface means 84 is defined in the head 80 and concentrically surrounds the axial sleeve bore 74 for guiding a lower end 86 of pressure communication mandrel 40 into the sleeve bore 74.

The pressure communication mandrel 40 has an enlarged diameter intermediate portion 88 located between an upper head 90 and the stinger portion 76, to strengthen the pressure communication mandrel 40.

When the pressure communication mandrel 40 is inserted into the mandrel sleeve 66, it is moved downward to the position shown in FIG. 6 wherein the head 90 abuts an upper end 92 of upper body portion 48 of plug body 46.

A plurality of O-ring seals 94 seal between the stinger means 76 and the sleeve bore 74.

As mentioned, the embodiment of the present invention illustrated in FIG. 6 is particularly adapted for use in an injection well. That is, with reference to FIG. 1, the well 10 may be considered to be an injection well which is used for the purpose of injecting fluid such as water, carbon dioxide, or the like, downward through the tubing string 24 and out through the perforations 27 into the formation 14. This may, for example, be in the context of a water flood or other secondary recovery operation. That is, water or other injected fluid may be pumped into well 10 and into the formation 14 so as to force hydrocarbons remaining in the formation 14 toward other adjacent producing wells.

When designing such a water flood operation, it is desirable to know how rapidly the pressure of fluid injected into the formation 14 falls off once injection is completed. This data is valuable to a reservoir engineer because it helps in the design of the overall water flood operation. It helps determine how many injection wells must be utilized, what spacing between wells is appropriate, and the like.

When measuring pressure fall-off data in an injection well, however, it is very desirable to be able to isolate the formation from the hydrostatic pressure within the well, so that the effect of the column of fluid contained in the well will not mask what is actually happening within the formation 14.

If, for example, the well is only shut in at the surface, then the column of fluid remaining in the tubing string 24 will continue to exert a substantial pressure on the formation 14.

Additional fluid will flow out of the tubing string 24 and into the formation 14, and the dropping column of fluid in tubing string 24 will exert a varying pressure on the formation 14.

All of this will tend to mask the actual pressure drop-off within the formation 14 which needs to be monitored. This is particularly true where the pressure drop-off occurs very rapidly, such as for example where a lost fluid zone may lie close to the well 10.

The pressure monitoring apparatus 34 shown in FIGS. 1 and 6 provides a means for shutting in the formation 14 at the bottom of the hole, that is at the elevation of the plug body 46. This isolates the formation 14 from the hydrostatic pressure in tubing string 24 so that the pressure falloff in the formation 14 can be monitored free of any effects from fluid standing in the well above the elevation of the formation 14.

The methods of monitoring pressure fall-off in the subsurface formation 14 after injection of fluid into that formation, which utilize the pressure monitoring apparatus 34 are conducted generally as follows.

When the well 10 is constructed, and the tubing string 24 is set in place therein, the landing nipple 32 must be provided at the proper depth as part of the tubing string 24. It is very typical in well construction that one or more such landing nipples will be commonly included in the tubing string so as to provide a means for setting various types of well tools in place within the well.

At the time that it is desired to perform a pressure fall-off test, the plug assembly 38 including the plug body 46 with the mandrel sleeve 66 in place therein is assembled and run down into the tubing string 24 and landed in the landing nipple 32. The locking dogs 60 will hold the plug assembly 38 in place within the landing nipple 32.

The injection of fluid into the well 10 may or may not be stopped while the plug assembly 38 is being run into place. In any event, however, the flow of fluid downward through the tubing string 24 will be significantly interrupted while the plug assembly 38 is being run into place.

Thus, after the plug assembly 38 is landed in the landing nipple 32, there will generally be a subsequent time interval during which fluid continues to be injected down through the tubing string and into the formation 14, so as to allow the fluid flow conditions within the formation 14 to equalize and approximate those conditions that would exist during a water flood operation.

When it is desired to actually perform the pressure fall-off test, the pressure sensor 42 and pressure communication mandrel 44 are connected together and lowered into the tubing string on the wireline 36. The running in of the pressure communication mandrel 40 will typically be halted with the pressure communication mandrel located a short distance above the plug assembly 38. Pressure readings may be taken to assure that the flow of injection fluid into the formation 14 has again stabilized.

Then, the pressure communication mandrel 40 is lowered into engagement with the plug assembly 38 so that the lower cylindrical mandrel portion or stinger 76 stings into the sleeve bore 74 of the mandrel sleeve 66, thereby shutting in the well 10 at the plug assembly 38 and isolating the formation 14 from the hydrostatic pressure of the fluid still contained in the tubing string 24 above the plug assembly 38. The lower end 86 of pressure communication mandrel 40 is guided into the sleeve bore 74 by the tapered guide surface means 84.

The fluid pressure within the formation 14 is communicated through the pressure communication passage means 78 of pressure communication mandrel 40 to the pressure sensing means 42 so that pressure fall-off in the formation 14 can be monitored after the formation 14 is shut in and isolated as just described.

The monitoring of pressure fall-off in the formation 14 may continue for a week or more.

After the monitoring is completed, the pressure sensor 42 and pressure communication mandrel 40 are pulled out of the plug assembly 38 by means of the wireline 36. The mandrel sleeve 66 remains in place within the plug body 46 when the pressure communication mandrel is pulled out.

It will be appreciated that at the completion of the monitoring of pressure fall-off data, there will typically be a very significant downward pressure differential acting across both the pressure communication mandrel 40 and the mandrel sleeve 66. This differential will be the difference between the hydrostatic pressure at the bottom of the column of fluid contained in tubing string 24, and the formation pressure within formation 14.

With regard to the pressure communication mandrel 40, this pressure differential will be acting downward across the circular area contained within the seals 94.

In order to pull the pressure communication mandrel 40 out of the plug assembly 38, the wireline 36 must support both the weight of the wireline and the attached apparatus, which may be on the order of many hundreds of pounds, plus the force required to overcome this downward pressure differential acting on the pressure communication mandrel 40 plus frictional forces between the pressure communication mandrel 40 and mandrel sleeve 66. Additionally, the deviation present in well 10 must be considered as that will increase the pulling load necessary at the surface to apply a given pulling load at the pressure communication mandrel located at the bottom of the hole.

Typical wireline apparatus will have a capacity of pulling with a force in the range from 1,000 to 2,000 pounds depending upon the size of the wireline. Once the weight of the wireline and other factors are accounted for, it is apparent that it maybe that only a few hundred pounds of force will be available for pulling the pressure communication mandrel 40 out of mandrel sleeve 66.

If the lower stinger portion 76 of the pressure communication mandrel 40 were constructed of a diameter sufficient to directly plug the body bore 62, it would be difficult if not impossible in many well applications to then pull the pressure communication mandrel 40 from the plug body 46 with standard available wireline apparatus.

The present invention overcomes this difficulty by the provision of the mandrel sleeve 66.

When the pressure communication mandrel 40 is pulled out of the plug assembly 38 illustrated in FIG. 6, the downward pressure differential previously described holds the mandrel sleeve 66 in place. It will be understood that this downward pressure differential acts across the annular area between seals 70 and seals 94.

Thus, the mandrel sleeve 66 reduces the upward force required to pull the pressure communication mandrel 40 out of the plug assembly 38 as compared to a force which would be required in the absence of the mandrel sleeve 66 to pull a larger pressure communication mandrel received directly in the body bore 62 of plug body 46.

After the pressure communication mandrel 40 is pulled out of the sleeve bore 74, the downward pressure differential equalizes across the plug assembly 38. Then, the plug assembly 38 can be retrieved from the tubing string 24 by running a fishing tool down through the tubing string 24 and grabbing onto the fishing neck 62 of plug body 46 and retrieving the same.

A working example of the embodiment of FIG. 6 has been constructed. This device was constructed for use in a well having 2 7/8 inch 0.D. well tubing 24 and having a Baker Packers Model "F" landing nipple with a 2.25 inch seal bore. A Baker Packers Model "FWG" plug was modified as shown. The plug bore 62 had a diameter of 0.75 inch. The stinger portion 76 of pressure communication mandrel 40 had an 0.D. of 0.375 inch.

METHODS OF MONITORING BOTTOM HOLE SHUT-IN PRESSURE BUILDUP IN PRODUCING WELLS

As mentioned, the pressure monitoring apparatus of the present invention can also be adapted for use in monitoring a bottom hole shut-in pressure buildup in a subsurface producing formation associated with a production well. That embodiment of the invention will now be described with regard to FIGS. 1 and 7.

In FIG. 7, the plug body 46 is substantially identical to the plug body 46 of FIG. 6, and the components shown in FIG. 7 which are identical to components or features shown in FIG. 6 are indicated with the same numerical designations previously utilized with reference to FIG. 6.

The features of the pressure monitoring apparatus shown in FIG. 7 which have been modified as compared to the embodiment of FIG. 6 are the pressure communication mandrel 200 and the mandrel sleeve 202.

The pressure communication mandrel 200 and mandrel sleeve 202 have been constructed to be assembled together and lowered into place after the plug body 46 has previously been landed in the landing nipple 32. Thus, it is the mandrel sleeve 202 which stings into the body bore 62 in the embodiment of FIG. 7, as compared to the embodiment of FIG. 6 in which the lower portion 76 of the pressure communication mandrel was designed to sting into the mandrel sleeve 66 which had previously been run into place with the plug body 46.

The mandrel sleeve 202 has a lower cylindrical sleeve portion 204 which is constructed to be sealingly received within the body bore 202 with a seal being provided therebetween by O-rings 206 set in external grooves of the mandrel sleeve 202.

Mandrel sleeve 202 has a lower end 208 which is tapered at 210 to aid in stinging the same into body bore 62.

Additionally, an annular guide ring 212 is supported by shoulder 82 of lower body portion 50, and has an annular conically tapered guide surface 214 defined therein for guiding the lower end 208 of mandrel sleeve 202 into the body bore 62.

Mandrel sleeve 202 includes an enlarged head 216 at its upper end which has a downwardly tapered outer surface 218 which is generally complementary to and abuts the guide surface 214. A maximum outside diameter of upper head 216 of mandrel sleeve 202 is small enough that when it is stung into plug body 46, it will not trip the latch dogs 60 which hold the plug body 46 in place within the landing nipple 32.

The pressure communication mandrel has a lower cylindrical mandrel portion 220 sealingly received within an axial sleeve bore 222 of mandrel sleeve 202. A plurality of O-ring seals 224 seal between the lower portion 220 of pressure communication mandrel 200 and the sleeve bore 222.

Pressure communication mandrel 200 has a lower end 226. Pressure communication mandrel 200 also includes an intermediate enlarged diameter portion 228, and an enlarged upper head 230.

A downward facing tapered shoulder 232 of pressure communication mandrel 200 is generally complementary to and seats against an inner tapered surface 234 defined in the upper head 216 of mandrel sleeve 202.

The mandrel sleeve 202 carries a latch means 236 for latching the mandrel sleeve 202 in place within the plug body 46 and for preventing an upward pressure differential across the mandrel sleeve 202 from blowing the mandrel sleeve 202 upwards out of the plug body 46. As is apparent in FIG. 7, the latch means 236 is an outwardly resilient latch which is constructed to pass through the body bore 62 and to expand after passing through the body bore 62 so as to prevent mandrel sleeve 202 from moving back upward out of the body bore 62. The latch 236 is carried by a lowermost part of lower portion 204 of mandrel sleeve 202 which extends through the body bore 62 and out a lower end 238 of the plug body 46.

A diameter of the sleeve bore 222 of mandrel sleeve 202 is relatively small so that the pressure communication mandrel 200 can be held in place within the sleeve bore 222 against an upward pressure differential by weight on the pressure communication mandrel 200 and by frictional engagement of the lower cylindrical mandrel portion 220 with the sleeve bore 222.

Preferably, the sleeve bore 222 has a diameter not substantially greater than about one-eighth inch. This provides a very small area against which the upward pressure differential can operate, thus providing a relatively slight upward force tending to blow the pressure communication mandrel 200 upward out of engagement with the mandrel sleeve 202.

The pressure communication mandrel 200 has a pressure communication passage 240 extending downward therethrough from its upper end 242 to its lower end 226. The pressure communication passage 240 will be of relatively small diameter as it passes through the lower portion 220 of pressure communication mandrel 200, but it will be sufficient to communicate fluid pressure to the pressure sensing means 42 which will be connected to the upper end 242 of pressure communication mandrel 200.

The method of monitoring a bottom hole shut-in pressure buildup in subsurface formation 14 can generally be described as follows with reference again to FIGS. 1 and 7.

First, the plug body 46 must be provided and seated in the landing nipple 32.

The plug body 46, when initially seated in landing nipple 32, will have its axial body bore 62 completely open. The mandrel sleeve 202 and pressure communication mandrel 200 will not be in place in the plug body 46 when the plug body 46 is first landed in the landing nipple 32.

Then, formation fluids may be produced from the formation 14 and flowed upwardly through a body bore 62 and the tubing string 24 in a generally unimpeded manner. The body bore 62 of plug body 46 is sufficiently large that there is no substantial choking of the flow of production fluids upward therethrough.

Then, the pressure sensor 42, pressure communication mandrel 200, and mandrel sleeve 202 are assembled together and run down through the tubing string 24 by the use of wireline 36. The pressure communication mandrel 200 and mandrel sleeve 202 are initially assembled in generally the manner seen in FIG. 7 with the lower cylindrical mandrel portion 220 of pressure communication mandrel 200 received in sliding sealing engagement within the axial sleeve bore 222.

The running in of the pressure sensor 42, pressure communication mandrel 200, and mandrel sleeve 202 can generally be accomplished while producing formation fluids upward through the tubing string 24.

The running in of these components is preferably stopped when the mandrel sleeve 202 is located a relatively short distance, perhaps a few feet or as much as a hundred feet or more, above the plug body 46.

Then, while production fluids are still flowing from the formation 14, a flowing pressure of the formation fluid is monitored by the pressure sensor 42. This monitoring is continued until it is apparent that the flow of production fluids is stabilized, that the pressure sensor 42 is stabilized at the temperature of the produced fluids and that a truly representative flowing pressure is being measured.

Then, the well 10 is shut in at the surface 12 by closing a wing valve (not shown) of the wellhead assembly 22 to close the upper end of tubing string 24. Substantially immediately after the well 10 is shut in at the surface, the wireline 24 is lowered to sting the lower cylindrical sleeve portion 204 of mandrel sleeve 202 into sealing engagement with the body bore 62 as illustrated in FIG. 7, thereby shutting in the well 10 at the plug body 46 and isolating the formation 14 from a hydrostatic pressure in the tubing string 24 above plug body 46.

The well 10 is initially shut in at the surface as described because it otherwise would often not be physically possible to sting the mandrel sleeve 202 into the plug body 46, due to the forces exerted by the fluids which are flowing upward through the plug body 46. Thus it is necessary to shut in the well at the surface to inhibit this upward fluid flow. Then within a relatively few seconds the mandrel sleeve 202 can be stung into the body bore 62 to shut in the well at the plug body 46.

The pressure within formation 14 is communicated through the pressure communication passage 240 of pressure communication mandrel 200 to the pressure sensor 42 while the formation 14 is shut in and isolated from the hydrostatic pressure in tubing string 24. This allows a bottom hole shut-in pressure buildup within formation 14 to be monitored. This monitoring may take anywhere from a matter of hours on an oil well to a matter of days or weeks on a gas well.

As previously mentioned, the diameter of the sleeve bore 222 is relatively small so that throughout this monitoring, as the pressure in formation 14 builds up and as the upward pressure differential acting on the pressure communication mandrel 200 increases, the pressure communication mandrel 200 can continually be held in place within the sleeve bore 202 by the weight of the pressure sensor 42 and other components bearing down upon pressure communication mandrel 200 and by the frictional engagement of the lower cylindrical portion 220 of pressure communication mandrel 200 with the sleeve bore 222.

After this monitoring is completed, the pressure communication mandrel 200 is pulled upward out of engagement with the sleeve bore 222 by pulling upward upon the wireline 36. The mandrel sleeve 202 will remain in place within the plug body 46, because it is held therein by the latch means 236.

The relatively small diameter of the sleeve bore 222 of mandrel sleeve 202 provides a second important advantage when the pressure communication mandrel 200 is pulled out of the sleeve bore 222. With the relatively small sleeve bore 222, the amount of fluid allowed to flow upward therethrough as the pressure from formation 14 equalizes across the mandrel sleeve 202 is sufficiently small that this upward flow will not blow the pressure communication mandrel 200 and other connected structures upward through the tubing string 24 as this pressure equalizes. It will be appreciated that a high pressure can build up below the plug body 46. If a large opening were quickly uncovered through plug body 46, the flow rate of formation fluid which would immediately flow upward therethrough would be extremely high and could carry with it the pressure communication mandrel 200 and other attached structures. This could cause great damage to the well. Such dangerous conditions are avoided with the present invention.

After the pressure buildup measurements have been taken, a standard pulling tool can be run in to engage the fishing neck 62 and pull the plug body 46 out of the well.

Thus it is seen that the apparatus and methods of the present invention are readily adapted to achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A pressure monitoring apparatus for use in a tubing string having a landing nipple located therein above a well zone which is to be monitored, comprising:

a plug body constructed to be sealingly landed in said landing nipple, said plug body having an axial body bore disposed therethrough;

a mandrel sleeve having a lower cylindrical sleeve portion constructed to be sealingly received in said body bore, said mandrel sleeve having an axial sleeve bore disposed therethrough;

a pressure communication mandrel having a lower cylindrical mandrel portion which is sealingly received in said sleeve bore, said pressure communication mandrel having a pressure communication passage means disposed therethrough for communicating with said well zone; and a pressure sensing means, connected to said pressure communication mandrel, for monitoring a pressure in said well zone with said well zone isolated from a hydrostatic pressure in said tubing string above said plug body.

2. The apparatus of claim 1, wherein:

said mandrel sleeve is further characterized as a means for reducing an outside diameter of said lower cylindrical mandrel portion required to plug said body bore of said plug body and for thereby reducing a downward pressure differential across said pressure communication mandrel which must be overcome to pull said pressure communication mandrel upward out of said plug body.

3. The apparatus of claim 1, wherein:

said mandrel sleeve has an enlarged head located above said lower cylindrical sleeve portion and said head abuts an upward facing annular shoulder defined within said plug body.

4. The apparatus of claim 3, wherein:

said mandrel sleeve has an inner conically downward tapered guide surface means defined in said head and concentrically surrounding said sleeve bore for guiding a lower end of said pressure communication mandrel into said sleeve bore.

5. The apparatus of claim 1, further comprising:

latch means, operatively associated with said plug body and said mandrel sleeve, for latching said mandrel sleeve in place within said plug body and for preventing an upward pressure differential across said mandrel sleeve from blowing said mandrel sleeve upward out of said plug body.

6. The apparatus of claim 5, wherein:

said lower cylindrical sleeve portion of said mandrel sleeve is constructed to extend through said body bore and out of a lower end of said plug body; and said latch means includes an outwardly resilient latch attached to said lower cylindrical sleeve portion and constructed to pass through said body bore and to expand after passing through said body bore to prevent said mandrel sleeve from moving back upward out of said body bore.

7. The apparatus of claim 5, wherein:

a diameter of said sleeve bore of said mandrel sleeve is relatively small so that said pressure communication mandrel can be held in place within said sleeve bore against said upward pressure differential by weight on said pressure communication mandrel and frictional engagement of said lower cylindrical mandrel portion with said sleeve bore.

8. The apparatus of claim 7, wherein:

said diameter of said sleeve bore is not substantially greater than approximately one-eighth inch.

9. The apparatus of claim 5, wherein:

said plug body, said mandrel sleeve and said pressure communication mandrel are so arranged and constructed that said mandrel sleeve and said pressure communication mandrel may be assembled together and then run into said tubing string and stung into said body bore of said plug body.

10. A method of monitoring pressure fall-off in a subsurface formation after injection of fluid into said formation, said method comprising the steps of:

(a) providing a plug assembly seated in a landing nipple in an injection tubing string of a well intersecting said formation, said plug assembly having a plug body with an axial body bore disposed therethrough and said plug assembly having a mandrel sleeve with a lower cylindrical sleeve portion sealingly received in said body bore, said mandrel sleeve having an axial sleeve bore disposed therethrough;

(b) injecting fluid down through said tubing string and into said formation;

(c) running a pressure sensor and a pressure communication mandrel together down through said tubing string;

(d) stinging a lower end of said pressure communication mandrel into sealing engagement with said sleeve bore and thereby shutting in said well at said plug assembly and isolating said formation from a hydrostatic pressure in said tubing string above said plug assembly;

(e) communicating said pressure sensor, through said pressure communication mandrel, with said formation while said formation is shut in and isolated from said hydrostatic pressure and thereby monitoring pressure falloff in said formation after injection of fluid; and (f) after said monitoring is completed, pulling said pressure sensor and said pressure communication mandrel out of said plug assembly while said mandrel sleeve remains in place in said plug body thus reducing an upward force required to pull said pressure communication mandrel out of said plug assembly as compared to a force which would be required in the absence of said mandrel sleeve to pull a larger pressure communication mandrel received directly in said body bore of said plug body.

11. The method of claim 10, further comprising the step of:

during said step (f), holding said mandrel sleeve in place within said plug body by means of a downward pressure exerted on said mandrel sleeve by said hydrostatic pressure in said tubing string above said plug body.

12. The method of claim 10, further comprising the steps of:

equalizing pressure across said plug assembly after said pressure communication mandrel is pulled out of said plug assembly; and then, retrieving said plug assembly from said tubing string.

13. The method of claim 10, further comprising the step of:

during step (d), guiding said lower end of said pressure communication mandrel into said sleeve bore by means of a conically downward tapered guide surface defined in an enlarged upper head of said mandrel sleeve.

14. The method of claim 10, wherein:

said step (f) is further characterized in that said pressure sensor and said pressure communication mandrel are pulled out of said plug assembly with a wireline.

15. A method of monitoring a bottom hole shut in pressure buildup in a subsurface producing formation, said method comprising the steps of:

(a) providing a plug body seated in a landing nipple in a production tubing string of a well intersecting said formation, said plug body having an axial body bore disposed therethrough;

(b) producing formation fluids up through said body bore and said tubing string;

(c) running a pressure sensor, a pressure communication mandrel and a mandrel sleeve together down through said tubing string, said pressure communication mandrel having a lower cylindrical mandrel portion received in sliding sealing engagement with an axial sleeve bore disposed through said mandrel sleeve;

(d) stinging a lower cylindrical sleeve portion of said mandrel sleeve into sealing engagement with said body bore and thereby shutting in said well at said plug body and isolating said formation from a hydrostatic pressure in said tubing string above said plug body;

(e) communicating said pressure sensor, through said pressure communication mandrel, with said formation while said formation is shut in and isolated from said hydrostatic pressure and thereby monitoring pressure buildup in said formation; and (f) after said monitoring is completed, pulling said pressure communication mandrel out of said mandrel sleeve while said mandrel sleeve remains in place in said plug body.

16. The method of claim 15, wherein:

said steps (a) and (b) are further characterized in that said body bore of said plug body provided in step (a) is sufficiently large that there is no substantial choking of a flow of production fluids upward therethrough in step (b).

17. The method of claim 15, wherein:

said step (c) is performed while producing formation fluids as described in said step (b).

18. The method of claim 17, wherein:

said step (c) is further characterized in that said running is stopped when said mandrel sleeve is a relatively short distance above said plug body;

said method further includes a step, between steps (c) and (d), of monitoring a flowing pressure of said formation fluid; and said step (d) is further characterized as being performed after said flowing pressure stabilizes.

19. The method of claim 15, wherein:

said method includes a step, prior to said step (d), of shutting in said well at a surface location; and step (d) is further characterized as being performed substantially immediately after said well is shut in at said surface location.

20. The method of claim 15, wherein:

said step (f) is further characterized in that a diameter of said sleeve bore of said mandrel sleeve is relatively small so that said pressure communication mandrel can be held in place within said sleeve bore against an upward pressure differential between said formation and said hydrostatic pressure by weight on said pressure communication mandrel and frictional engagement of said lower cylindrical mandrel portion with said sleeve bore.

21. The method of claim 20, wherein:

said step (f) is further characterized in that said diameter of said sleeve bore of said mandrel sleeve is relatively small so as to allow pressure to equalize therethrough without blowing said pressure communication mandrel up through said tubing string after said pressure communication mandrel is pulled out of said mandrel sleeve.

22. The method of claim 21, wherein:

said step (f) is further characterized in that said diameter of said sleeve bore is not substantially greater than about one-eighth inch.

23. The method of claim 15, wherein:

said step (f) is further characterized in that a diameter of said sleeve bore of said mandrel sleeve is relatively small so as to allow pressure to equalize therethrough without blowing said pressure communication mandrel up through said tubing string after said pressure communication mandrel is pulled out of said mandrel sleeve.

24. The method of claim 15, wherein:

said step (d) is further characterized as including a step of latching said mandrel sleeve into place in said plug body.

25. The method of claim 15, wherein:

said steps (c) and (f) are further characterized in that said pressure communication mandrel is run in and pulled out with a wireline.

* * * * *